US011609516B2

(12) United States Patent
Takeda et al.

(10) Patent No.: US 11,609,516 B2
(45) Date of Patent: Mar. 21, 2023

(54) FIXING APPARATUS AND IMAGE FORMING APPARATUS

(71) Applicant: CANON KABUSHIKI KAISHA, Tokyo (JP)

(72) Inventors: Isamu Takeda, Tokyo (JP); Takanori Mitani, Kanagawa (JP); Satoshi Nishida, Kanagawa (JP); Takeshi Shinji, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/865,800

(22) Filed: Jul. 15, 2022

(65) Prior Publication Data

US 2022/0350280 A1 Nov. 3, 2022

Related U.S. Application Data

(63) Continuation of application No. 17/356,773, filed on Jun. 24, 2021, now Pat. No. 11,422,489.

(30) Foreign Application Priority Data

Jul. 15, 2020 (JP) ..... JP2020-121235

(51) Int. Cl.
*G03G 15/20* (2006.01)
*G03G 9/09* (2006.01)

(52) U.S. Cl.
CPC ..... *G03G 15/2007* (2013.01); *G03G 9/0906* (2013.01); *G03G 15/206* (2013.01);
(Continued)

(58) Field of Classification Search
None
See application file for complete search history.

(56) References Cited

U.S. PATENT DOCUMENTS 5,724,638 A 3/1998 Isogai
9,195,193 B2 11/2015 Suzuki
(Continued)

FOREIGN PATENT DOCUMENTS

CN 109257837 A 1/2019
JP H05113729 A 5/1993
(Continued)

OTHER PUBLICATIONS

Wade et al., Fujihokka: A High-Emissivity Approach to Aluminum Anodizing, Metal Finishing, vol. 101, Issue 12, Dec. 2003, pp. 8-13.*

(Continued)

*Primary Examiner* — Sevan A Aydin
(74) *Attorney, Agent, or Firm* — Rossi, Kimms & McDowell LLP

(57) ABSTRACT

A fixing apparatus includes an endless first rotary member, a heating element, a second rotary member configured to form a nip portion, and a nip member configured to receive radiant heat from the heating element and heat the nip portion. The nip member includes a main-body portion that contains aluminum or aluminum alloy and a protective layer that includes an oxide film formed on a surface of the main-body portion. The main-body portion contains a heat receiving surface that faces the heating element and receives radiant heat from the heating element, and a rubbed surface that is rubbed against the inner circumferential surface of the first rotary member. The protective layer contains coloring agent that causes an emissivity of the heat receiving surface and the rubbed surface to be higher than an emissivity of a natural color oxide film.

9 Claims, 5 Drawing Sheets

(52) U.S. Cl.
CPC ..... *G03G 15/2028* (2013.01); *G03G 15/2057* (2013.01); *G03G 2215/2035* (2013.01)

(56) References Cited

U.S. PATENT DOCUMENTS

| | | | | |
|---|---|---|---|---|
| 2008/0212169 | A1 | 9/2008 | Groenen | |
| 2011/0299898 | A1 | 12/2011 | Ito | |
| 2012/0121304 | A1 | 5/2012 | Tokuda | |
| 2012/0121305 | A1 | 5/2012 | Yoshikawa | |
| 2012/0148303 | A1 | 6/2012 | Yamaguchi | |
| 2012/0155936 | A1 | 6/2012 | Yamaguchi | |
| 2012/0163886 | A1 | 6/2012 | Suzuki | |
| 2013/0330111 | A1 | 12/2013 | Tokuda | |
| 2014/0270876 | A1* | 9/2014 | Yamashita | G03G 15/2053 399/329 |
| 2015/0063413 | A1 | 3/2015 | Kubota | |
| 2016/0349675 | A1 | 12/2016 | Yamamoto | |
| 2021/0223729 | A1 | 7/2021 | Maeda | |

FOREIGN PATENT DOCUMENTS

| | | | |
|---|---|---|---|
| JP | 2009116133 | A | 5/2009 |
| JP | 2012141380 | A | 7/2012 |
| JP | 2016009008 | A | 1/2016 |
| JP | 2018101159 | A | 6/2018 |

OTHER PUBLICATIONS

Wade. "Fujihokka: A High-Emissivity Approach to Aluminum Anodizing." Metal Finishing. Dec. 2003: 8-13. vol. 101, Issue 12.
Office Action issued in U.S. Appl. No. 17/356,773 dated Dec. 13, 2021.
Office Action issued in U.S. Appl. No. 17/356,773 dated Dec. 16, 2021.
Notice of Allowance issued in U.S. Appl. No. 17/356,773 dated Apr. 20, 2022.

* cited by examiner

FIXING APPARATUS AND IMAGE FORMING APPARATUS

BACKGROUND OF THE INVENTION

Field of the Invention

The present invention relates to a fixing apparatus that fixes a toner image to a sheet, and an image forming apparatus that includes the fixing apparatus.

Description of the Related Art

Image forming apparatuses include a fixing apparatus that applies heat and pressure to a sheet on which a toner image is formed, and thereby fixes the toner image to the sheet. Japanese Patent Application Publication No. 2012-141380 proposes a fixing apparatus that includes an endless fixing belt0025, a roller (referred to as a pressing roller), a halogen lamp, and a nip member. The pressing roller is in contact with the outer circumferential surface of the fixing belt. The halogen lamp is disposed inside the fixing belt, and generates radiant heat for heating the fixing belt. The nip member is made of a material, such as aluminum or aluminum alloy, and is rubbed against the inner circumferential surface of the fixing belt such that the fixing belt is nipped by the nip member and the pressing roller. When a sheet on which a toner image is formed passes through a nip portion formed between the fixing belt and the pressing roller, heat and pressure are applied to the sheet, and the toner image is fixed to the sheet.

On a surface (referred to as a rubbed surface) of the nip member that is rubbed against the fixing belt, a protective layer with high wear resistance is formed for suppressing wear of the fixing belt and the nip member. The protective layer is a film formed on a surface of a main-body portion made of a material, such as aluminum or aluminum alloy. The film is a nickel-phosphorus alloy film, or an oxide film formed through anodic oxidation coating treatment. In addition, on a surface (referred to as a heat receiving surface) of the nip member that receives the radiant heat from the halogen lamp, black paint with high emissivity (radiation factor) is applied, or a heat absorbing member is disposed for efficiently absorbing the radiant heat from the halogen lamp and transmitting the radiant heat to the fixing belt.

Thus, in the conventional nip member, the protective layer is formed on the rubbed surface, and the heat receiving surface is colored for absorbing the radiant heat from the halogen lamp and heating the fixing belt by using the radiant heat. However, since the rubbed surface and the heat receiving surface of the nip member have different expansion coefficients, the nip member may warp. If the nip member warps, the pressure is not uniformly applied to the fixing belt, and the nip portion is not properly formed by the nip member and the pressing roller. As a result, one portion of a toner image may not be fixed to a sheet.

SUMMARY OF THE INVENTION

According to one aspect of the present invention, a fixing apparatus includes an endless first rotary member, a heating element disposed inside the first rotary member, a second rotary member configured to form a nip portion by being contact with an outer circumferential surface of the first rotary member and convey a sheet on which a toner image is formed while fixing the toner image onto the sheet, and a nip member disposed to be rubbed against an inner circumferential surface of the first rotary member and nip the first rotary member with the second rotary member, the nip member being configured to receive radiant heat from the heating element and heat the nip portion, the nip member comprising a main-body portion that contains aluminum or aluminum alloy and a protective layer that includes an oxide film formed on a surface of the main-body portion, wherein the main-body portion comprises a heat receiving surface that faces the heating element and receives radiant heat from the heating element, and a rubbed surface that is rubbed against the inner circumferential surface of the first rotary member, and wherein the protective layer is formed on the heat receiving surface and the rubbed surface, and contains coloring agent that causes an emissivity of the heat receiving surface and the rubbed surface to be higher than an emissivity of a natural color oxide film.

Further features of the present invention will become apparent from the following description of exemplary embodiments with reference to the attached drawings.

DESCRIPTION OF THE EMBODIMENTS

Image Forming Apparatus

Figure 1:
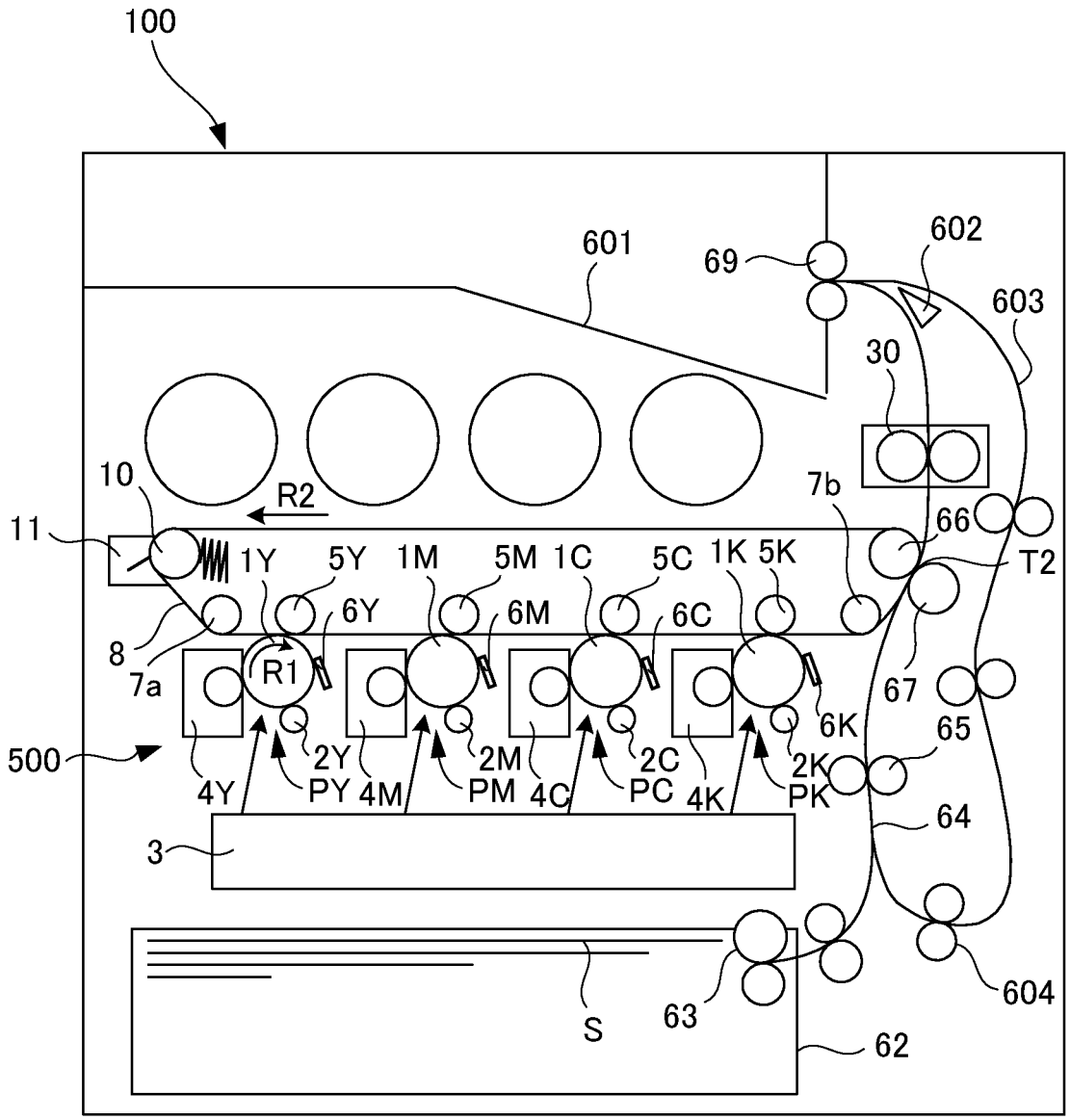
FIG. 1 is a schematic diagram illustrating a configuration of an image forming apparatus of the present embodiment.

Hereinafter, the present embodiment will be described. First, a configuration of an image forming apparatus of the present embodiment will be described with reference to FIG. 1. An image forming apparatus 100 illustrated in FIG. 1 is a full-color printer having an intermediate-transfer tandem system. Specifically, the image forming apparatus 100 includes a plurality of image forming portions PY, PM, PC, and PK, disposed along an intermediate transfer belt 8. The image forming portions PY, PM, PC, and PK respectively correspond to yellow, magenta, cyan, and black.

The image forming apparatus 100 forms an image on a sheet S in accordance with image information sent from a document reading apparatus (not illustrated) connected to an apparatus body, or from an external device (not illustrated), such as a personal computer, communicatively connected to the apparatus body. The sheet S may be of various sheet materials including a paper sheet, a plastic film, and a cloth sheet. The paper sheet may be a plain paper sheet, a thick paper sheet, a rough paper sheet, an embossed paper sheet, or a coated paper sheet. In the present embodiment, the image forming apparatus 100 includes a toner image forming unit 500 that forms a toner image on the sheet S. The toner image forming unit 500 includes the image forming portions PY to PK, primary transfer rollers 5Y to 5K, the intermediate transfer belt 8, a secondary transfer inner roller 66, and a secondary transfer outer roller 67.

Next, a conveyance process for the sheet S will be described. For example, the sheet S is stacked in a cassette 62, and fed to a conveyance path 64 one by one, by a sheet feeding roller 63 at an image forming timing. In another case, the sheet S is stacked on a manual feed tray (not illustrated), and fed to the conveyance path 64 one by one.

The sheet S is conveyed to a registration roller 65 disposed on the conveyance path 64, and skew correction and timing correction is performed on the sheet S by the registration roller 65. Then, the sheet S is sent to a secondary transfer portion T2 by the registration roller 65. The secondary transfer portion T2 is a transfer nip portion formed by the secondary transfer inner roller 66 and the secondary transfer outer roller 67, which face each other. In the secondary transfer portion T2, a secondary transfer voltage is applied to the secondary transfer inner roller 66, so that a toner image is secondary-transferred from the intermediate transfer belt 8 onto the sheet S.

In synchronization with the above-described conveyance process for the sheet S performed in a portion from the cassette 62 to the secondary transfer portion T2, an image is sent to the secondary transfer portion T2. Next, an image forming process for the image will be described. First, the image forming portions PY, PM, PC, and PK will be described. Note that the image forming portions PY, PM, PC, and PK have substantially the same configuration except that developing apparatuses 4Y, 4M, 4C, and 4K respectively use toner of yellow, magenta, cyan, and black. Thus, in the following description, the image forming portion PY for yellow will be described as an example, and the description for the other image forming portions PM, PC, and PK will be omitted.

The image forming portion PY mainly includes a photosensitive drum 1Y, a charging apparatus 2Y, the developing apparatus 4Y, and a drum cleaner 6Y. The surface of the rotary photosensitive drum 1Y is uniformly charged in advance by the charging apparatus 2Y, and then an electrostatic latent image is formed on the surface of the photosensitive drum 1Y by an exposure apparatus 3, which is driven in accordance with an image information signal. The electrostatic latent image formed on the photosensitive drum 1Y is then visualized by developing the electrostatic latent image into a toner image by the developing apparatus 4Y. After that, a predetermined pressure and primary transfer voltage are applied to the toner image formed on the photosensitive drum 1Y, by the primary transfer roller 5Y disposed so as to face the image forming portion PY via the intermediate transfer belt 8; and the toner image is primary-transferred onto the intermediate transfer belt 8. Transfer residual toner having been slightly left on the photosensitive drum 1Y after the primary transfer is removed by the drum cleaner 6Y.

The intermediate transfer belt 8 is stretched across a tension roller 10, the secondary transfer inner roller 66, and stretching rollers 7*a* and 7*b;* and is driven so as to move in a direction indicated by an arrow R2 of FIG. 1. In the present embodiment, the secondary transfer inner roller 66 serves also as a driving roller that drives the intermediate transfer belt 8. As described above, the image forming portions PY to PK perform their image forming processes. An image forming process for each color is performed such that one toner image is transferred onto another toner image that has been primary-transferred onto the intermediate transfer belt 8 at a position located upstream of the position of the one toner image in the moving direction of the intermediate transfer belt 8. As a result, a full-color toner image is formed on the intermediate transfer belt 8, and conveyed to the secondary transfer portion T2. The transfer residual toner left on the intermediate transfer belt 8 after the sheet has passed through the secondary transfer portion T2 is removed from the intermediate transfer belt 8 by a transfer cleaner apparatus 11.

Thus, the sheet S that has been subjected to the above-described conveyance process and the full-color toner image that has been produced through the above-described image forming process reach the secondary transfer portion T2 at the same timing, and the toner image is secondary-transferred from the intermediate transfer belt 8 onto the sheet S. The sheet S onto which the toner image has been transferred is then conveyed to the fixing apparatus 30. In the fixing apparatus 30, heat and pressure are applied to the toner image, so that the toner image is melted and solidified, that is, fixed to the sheet S. The fixing apparatus 30 of the present embodiment will be described in detail later (see FIG. 2).

When the single-side printing is performed, the sheet S to which the toner image has been fixed by the fixing apparatus 30 is discharged onto a sheet discharging tray 601 by a sheet discharging roller 69 that rotates in a forward direction. On the other hand, when the double-side printing is performed, the sheet S is conveyed by the sheet discharging roller 69 that rotates in the forward direction, until the trailing edge of the sheet S passes a switching member 602. Then, the sheet discharging roller 69 is rotated in the backward direction; and the sheet S is conveyed to a duplex conveyance path 603, with the trailing edge serving as the leading edge. The sheet S is then sent to the conveyance path 64 again by a sheet refeeding roller 604. Since the conveyance performed after that and the image forming process performed on a second side of the sheet S are the same as those described above, the description thereof will be omitted.

Fixing Apparatus

Figure 2:
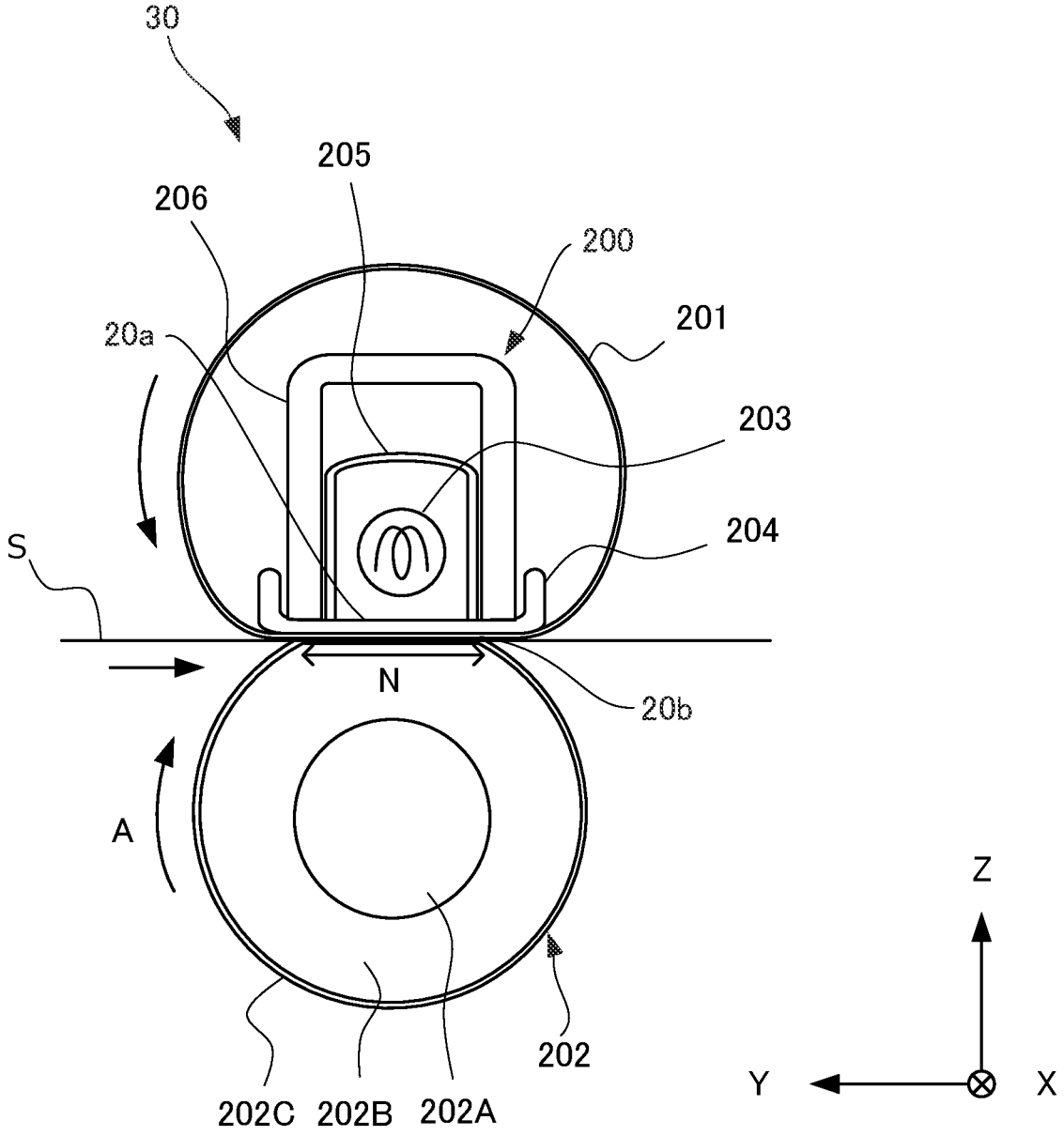
FIG. 2 is a schematic diagram illustrating a fixing apparatus of the present embodiment.

Next, the fixing apparatus 30 of the present embodiment will be described with reference to FIG. 2. As illustrated in FIG. 2, the fixing apparatus 30 includes an endless fixing belt 201, a heating unit 200 that heats the fixing belt 201, and a pressing roller 202. The pressing roller 202 and the heating unit 200 nip the fixing belt 201. Note that the fixing belt 201 described in this specification may be formed like a thin film.

The fixing belt 201 that serves as a first rotary member is an endless belt with flexibility. The fixing belt 201 is made of resin, such as polyimide, or stainless steel having high thermal conductivity and low heat capacity. In recent years, the fixing belt 201 made of polyimide resin is often used. The fixing belt 201 is rotatably disposed, and lubricant is applied onto the inner circumferential surface of the fixing belt 201 for ensuring sliding property between the fixing belt 201 and the later-described nip member 204. In addition, guide members (not illustrated) are disposed at both end portions of the fixing belt 201 in the rotation-axis direction (X direction) of the fixing belt 201, for guiding the fixing belt 201 to rotate and regulating the fixing belt 201 from moving in the rotation-axis direction.

The heating unit 200 is disposed on the inner circumferential surface side of the fixing belt 201, and includes a halogen lamp 203, the nip member 204, a reflective plate 205, and a supporting member 206. The halogen lamp 203 serves as a heating element; and is located, separated from the fixing belt 201 and the nip member 204 by a predetermined distance. The halogen lamp 203 generates radiant heat for heating the fixing belt 201. The temperature of the radiant heat generated by the halogen lamp 203 changes in accordance with the amount of power supplied from a power supply (not illustrated). In the present embodiment, the temperature of the radiant heat generated by the halogen lamp 203 is adjusted by a control unit (not illustrated) controlling the amount of power supplied to the halogen lamp 203, such that the temperature of a fixing nip portion N detected by a temperature sensor (not illustrated) is kept at a predetermined target temperature.

The nip member 204 is a long member that is disposed so as not to rotate with respect to the fixing belt 201 that rotates, and that extends in the rotation-axis direction so as to be rubbed against the inner circumferential surface of the fixing belt 201. As described above, the halogen lamp 203 generates the radiant heat for heating the fixing belt 201. When the halogen lamp 203 generates the radiant heat, the nip member 204 receives the radiant heat from the halogen lamp 203. For allowing the halogen lamp 203 to efficiently heat the fixing belt 201, the nip member 204 includes a heat receiving surface 20*a* that receives the radiant heat from the halogen lamp 203. Thus, the nip member 204 absorbs the radiant heat that the heat receiving surface 20*a* receives from the halogen lamp 203, and transmits the radiant heat to the fixing belt 201. In the present embodiment, for efficiently absorbing the radiant heat from the halogen lamp 203 and transmitting the radiant heat to the fixing belt 201 for heating the fixing nip portion N, the whole surface of the nip member 204 is covered with a protective layer, and the nip member 204 is colored so as to have a dark color similar to black, by using a coloring agent having a high emissivity (radiation factor). The detailed structure of the nip member 204 will be described later (see FIGS. 3 and 4).

The reflective plate 205 reflects the radiant heat generated by the halogen lamp 203, toward the nip member 204. The reflective plate 205 is disposed, separated from the halogen lamp 203 by a predetermined distance such that the halogen lamp 203 is surrounded by the reflective plate 205 and the nip member 204. Thus, the reflective plate 205 is formed by bending a plate (e.g., aluminum plate) with high reflectivity to the infrared and far-infrared rays, such that the plate has a substantially U-shaped cross section. Since the radiant heat from the halogen lamp 203 is directed to the nip member 204 by the reflective plate 205, the radiant heat from the halogen lamp 203 can be efficiently used, and thus the fixing belt 201 can be quickly heated by the radiant heat via the nip member 204.

The supporting member 206 supports the nip member 204. The supporting member 206 is made of rigid metal, such as stainless steel or spring steel, and formed along the outer surface of the reflective plate 205. In the present embodiment, the nip member 204 supported by the supporting member 206 presses the fixing belt 201 from the inner surface side of the fixing belt 201 toward the pressing roller 202, and thereby more reliably forms the fixing nip portion N.

The pressing roller 202 serves as a second rotary member, and is rotatably disposed. In the present embodiment, the pressing roller 202 is rotated by a driving motor (not illustrated) at a predetermined circumferential speed, in a direction indicated by an arrow A. When the pressing roller 202 rotates, the rotational force of the pressing roller 202 is transmitted to the fixing belt 201 by the frictional force produced in the fixing nip portion N. In this manner, the fixing belt 201 is rotated by the rotation of the pressing roller 202. The pressing roller 202 includes a core metal 202A, an elastic layer 202B, and a release layer 202C. The core metal 202A serves as a rotation shaft, and is made of metal. The elastic layer 202B is formed on the outer circumferential surface of the core metal 202A, and made of a material such as silicone rubber. The release layer 202C is formed on the outer circumferential surface of the elastic layer 202B, and made of a fluororesin, such as PTFE, PFA, or FEP. Both end portions of the core metal 202A in the rotation-axis direction (X direction) of the pressing roller 202 are rotatably supported by shaft bearing portions (not illustrated).

In the present embodiment, the pressing roller 202 is urged by an urging mechanism (not illustrated), such as springs, toward the fixing belt 201. Specifically, the pressing roller 202 is urged by a predetermined urging force via the shaft bearing portions (not illustrated). Thus, the fixing belt 201 and the pressing roller 202 are brought into pressure contact with each other by a desired pressure contact force. When the fixing belt 201 and the pressing roller 202 are brought into pressure contact with each other, the fixing nip portion N is formed between the fixing belt 201 and the pressing roller 202. In the fixing nip portion N, a toner image is heated and fixed to a sheet S while the sheet S passes through the fixing nip portion N in a state where the sheet S is pressed between the fixing belt 201 and the pressing roller 202. Note that the nip member 204 may be urged toward the pressing roller 202 by springs or the like for forming the fixing nip portion N.

As described above, the nip member 204 is heated by the radiant heat sent from the halogen lamp 203 and the radiant heat reflected by the reflective plate 205, so that the temperature of the fixing belt 201 increases. The sheet S on which a toner image is formed is heated and pressed in the fixing nip portion N when the sheet S is nipped and conveyed by the rotating fixing belt 201 and pressing roller 202, so that the toner image is fixed to the sheet S.

Nip Member

Figure 3:
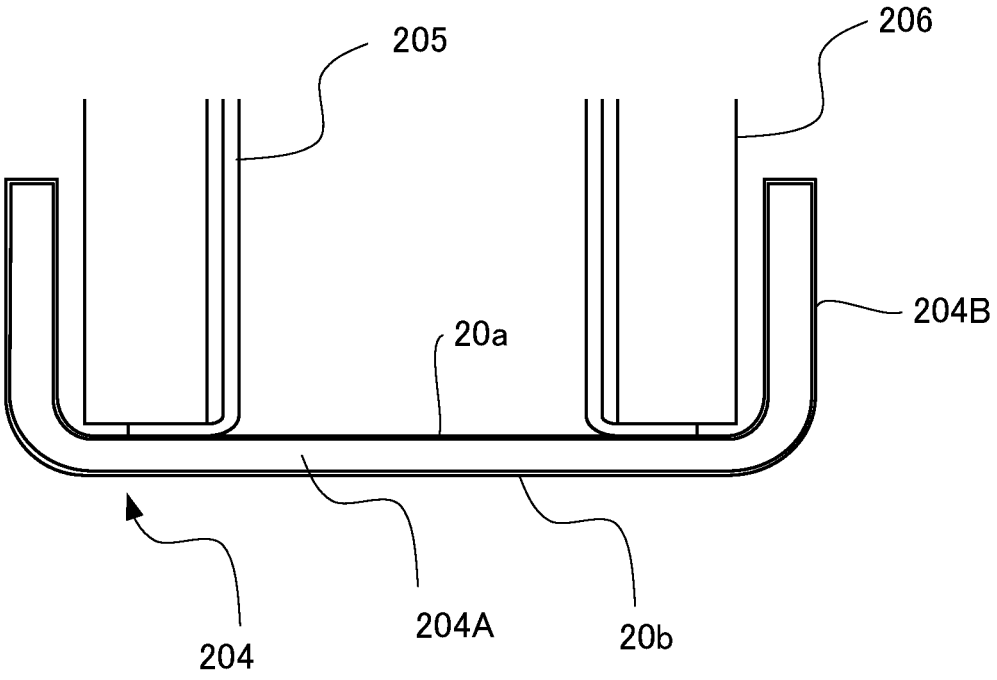
FIG. 3 is a cross-sectional view illustrating a nip member.
Figure 4:
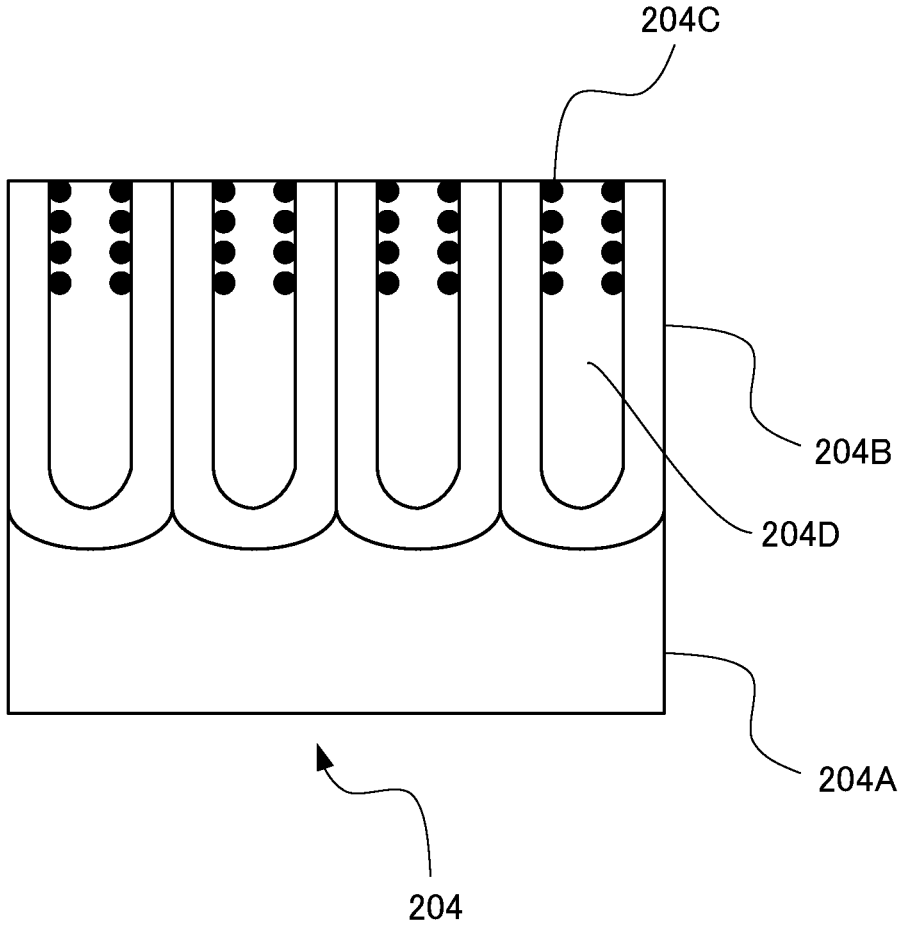
FIG. 4 is a schematic diagram for illustrating coloring of a nip member made of aluminum.

Next, the above-described nip member 204 will be described in detail with reference to FIG. 2 and FIGS. 3 and 4. As described above, the nip member 204 is provided for more reliably forming the fixing nip portion N between the fixing belt 201 and the pressing roller 202, and for receiving the radiant heat from the halogen lamp 203 and efficiently transmitting the radiant heat to the fixing belt 201. Thus, the nip member 204 is required to have higher thermal conductivity, higher wear resistance, and higher emissivity (radiation factor).

First, a configuration to achieve a desired thermal conductivity of the nip member 204 will be described. As illustrated in FIG. 3, the nip member 204 includes a main-body portion 204A made of pure aluminum (A1050), as a base material, with high thermal conductivity. Since the pure aluminum that contains 99.0% wt aluminum or more has a higher thermal conductivity in metals, it is suitably used for the nip member 204 that receives the radiant heat from the halogen lamp 203 and transmits the radiant heat to the fixing belt 201. The thermal conductivity of the pure aluminum (A1050) is within ±10% with respect to a value of 0.23 kW/m·K. Note that the thermal conductivity can be obtained by measuring a thermal diffusivity and a specific heat by using a laser-flash-method thermophysical property measuring apparatus LFA-502 (made by Kyoto Electronics Manufacturing Co., Ltd.), measuring a density by using an electronic-balance precision densimeter AUX220+SMK-401 (made by SHIMADZU CORPORATION), and calculating the thermal conductivity by using the measured thermal diffusivity, specific heat, and specific gravity.

Next, a configuration to achieve a desired wear resistance of the nip member 204 will be described. One of the nip member 204 that does not rotate and the fixing belt 201 that rotates is rubbed against the other. Thus, a rubbed surface 20*b* of the nip member 204 that is rubbed against the fixing belt 201, and the inner circumferential surface of the fixing belt 201 that is rubbed against the nip member 204 would be worn. If the rubbed surface 20*b* of the nip member 204 is rubbed against the fixing belt 201 and worn, aluminum powder is produced. The aluminum powder causes the rubbed surface 20*b* of the nip member 204 to be further worn, and the inner circumferential surface of the fixing belt 201 to be further worn. In addition, if the powder produced when the nip member 204 is worn and the powder produced when the fixing belt 201 is worn are adsorbed to the lubricant applied on the inner circumferential surface of the fixing belt 201, the powders will deteriorate the sliding property between the fixing belt 201 and the nip member 204. If the sliding property between the fixing belt 201 and the nip member 204 deteriorates, the driving torque of the pressing roller 202 may increase, and the noise may be produced due to the stick-slip phenomenon. Thus, the deterioration of the sliding property is not preferable.

For this reason, the whole surface of the nip member 204, which includes the rubbed surface 20*b* and the heat receiving surface 20*a* of the main-body portion 204A made of aluminum, is covered with a protective layer 204B. The protective layer 204B is an oxide-film layer formed by performing anodic oxidation treatment on the main-body portion 204A. The anodic oxidation treatment is a so-called alumite treatment (natural coloring method). In the anodic oxidation treatment, a diluted acid solution is electrolyzed by using a fully-degreased aluminum component (i.e., main-body portion 204A in the present embodiment) that is put in the solution and serves as an anode, so that an aluminum-oxide film is formed on the surface of the main-body portion 204A by the action of the oxygen produced when the solution is electrolyzed. Thus, since the oxide-film protective layer 204B is formed on the whole surface of the main-body portion 204A, the rubbed surface 20*b* that is rubbed against the fixing belt 201 can be suppressed from being worn.

The hardness of the above-described protective layer 204B will be described. The base material of the fixing belt 201 is a polyimide resin, and the Vickers hardness of the polyimide resin measured by using a Vickers hardness tester MMT-X7 (made by Matsuzawa Co., Ltd) is about 100 (test load: 0.049 N). On the other hand, the base material of the main-body portion 204A is a pure aluminum, and the Vickers hardness of the pure aluminum is about 30 (test load: 0.98 N). Note that the test load is set in accordance with an object to be measured. Since the Vickers hardness generally does not depend on the test load, it is possible to compare measured objects with each other even if the objects were measured with different test loads. The Vickers hardness varies depending on objects, and has a measurement error within ±10%.

Table 1 illustrates a relationship between the Vickers hardness of the protective layer 204B and the wear of the protective layer 204B produced when the protective layer 204B is rubbed against the fixing belt 201. In Table 1, the relationship between the Vickers hardness and the wear of the protective layer 204B is illustrated in each of alumite treatments A, B, and C. In each of the alumite treatments A, B, and C, the protective layer 204B having a different thickness is formed on the surface of the main-body portion 204A whose base material is pure aluminum.

TABLE 1

| | THICKNESS OF OXIDE FILM LAYER | VICKERS HARDNESS HV | SURFACE OF NIP MEMBER |
|---|---|---|---|
| NO ALUMITE TREATMENT | — | 30 | WORN |
| ALUMITE TREATMENT A | 10 μm | 150 | NOT WORN |
| ALUMITE TREATMENT B | 20 μm | 200 | NOT WORN |
| ALUMITE TREATMENT C | 50 μm | 400 | NOT WORN |

In Table 1, if the Vickers hardness of the protective layer 204B is 150 or more (test load: 0.98 N), the protective layer 204B that is rubbed against the fixing belt 201 is not worn. This is because the surface of the nip member 204 is covered with the protective layer 204B formed through the alumite treatment and having a higher hardness, and the wear of the nip member 204 caused when the nip member 204 is rubbed against the fixing belt 201 is suppressed. When the protective layer 204B is rubbed against the fixing belt 201, the inner circumferential surface of the fixing belt 201 is worn and the powder is slightly produced from the inner circumferential surface of the fixing belt 201. However, the powder hardly affects the sliding property between the nip member 204 and the fixing belt 201. Thus, in the present embodiment, the protective layer 204B of the nip member 204 having a thickness of 10 μm or more is formed through the alumite treatment.

Next, a configuration to achieve a desired emissivity of the nip member 204 will be described. In the present embodiment, for making the emissivity of the nip member 204 higher than the emissivity of a natural color oxide film, the whole surface of the nip member 204, which includes the rubbed surface 20*b* and the heat receiving surface 20*a*, is colored black. As described above, the oxide-film protective layer 204B is formed on the whole surface of the main-body portion 204A of the nip member 204 through the alumite treatment. The oxide film formed through the alumite treatment is a porous film. Thus, the protective layer 204B has a large number of micropores. In other words, the alumite treatment is performed on the main-body portion 204A for forming the protective layer 204B that has a large number of micropores formed in the surface of the main-body portion 204A.

Since the black body has the maximum emissivity of 1.0, the surface of the nip member 204 of the present embodiment is colored with a black coloring agent so that the surface of the nip member 204 is formed like the black body. In the coloring treatment of the present embodiment, the main-body portion 204A on which the protective layer 204B is formed is soaked in an aqueous solution that contains chromium complex salt dye, then the aqueous solution is stirred for a predetermined period of time, and then the main-body portion 204A is pulled up and washed in water (dyeing method). In this case, as illustrated in FIG. 4, a coloring agent 204C can be adsorbed to an inner portion of each of micropores 204D of the oxide-film protective layer 204B formed on the surface of the main-body portion 204A. Then a sealing treatment is performed, so that the coloring agent 204C is fixed to the micropores 204D. Note that although the coloring agent 204C is preferably black for achieving the maximum emissivity, the coloring agent 204C may have a dark color similar to black. In the present embodiment, the emissivity of the protective layer 204B that contains the coloring agent 204C is 0.85 or more and 1.0 or less.

As described above, the nip member 204 includes the main-body portion 204A, and the protective layer 204B formed on the whole surface of the main-body portion 204A. The base material of the main-body portion 204A is a pure aluminum; and the protective layer 204B is formed through the alumite treatment and the coloring treatment, and contains the black coloring agent. The nip member 204 was heated by the halogen lamp 203, and the surface temperature of the fixing belt 201 was measured. The measurement result is illustrated in Table 2. Table 2 also illustrates the measurement result obtained in a comparative example, for comparing the nip member 204 of the present embodiment with a nip member of the comparative example. The nip member of the comparative example includes the main-body portion 204A and a protective layer formed on the whole surface of the main-body portion 204A. The base material of the main-body portion 204A is the pure aluminum; and the protective layer is formed through the alumite treatment alone, and does not contain the black coloring agent. As measurement conditions, the thickness and the outer diameter of the fixing belt 201 were set at 100 μm and 24 mm, and the outer diameter of the pressing roller 202 was set at 24 mm. In addition, the fixing belt 201 and the pressing roller 202 were brought into pressure contact with each other by a pressure applying force of 147 N such that the nip width of the fixing nip portion N in the sheet conveyance direction was 9.0 mm. Then the pressing roller 202 was started to rotate at a rotational speed of 200 mm/sec when the temperature of the fixing belt 201 became equal to a room temperature (23° C.), and the temperature of the fixing belt 201 was increased by the halogen lamp 203.

TABLE 2

| | TEMPERATURE OF FIXING BELT OBTAINED WHEN 5 SECONDS HAS ELAPSED |
|---|---|
| PRESENT EMBODIMENT | 160° C. |
| COMPARATIVE EMBODIMENT 1 | 152° C. |

As illustrated in Table 2, in the comparative example, the surface temperature of the fixing belt 201 was 152° C. when 5 seconds had elapsed since the start of heating by the halogen lamp 203. On the other hand, in the present embodiment, the surface temperature of the fixing belt 201 reached 160° C. when 5 seconds had elapsed since the start of heating by the halogen lamp 203. Thus, the nip member 204 of the present embodiment has an emissivity higher than that of the nip member of the comparative example, and can more efficiently transmit the heat from the halogen lamp 203, to the fixing belt 201.

As described above, in the present embodiment, the oxide-film protective layer 204B is formed by performing the alumite treatment on the main-body portion 204A whose base material is aluminum. The protective layer 204B is formed on the whole surface of the main-body portion 204A, which includes the rubbed surface 20*b* and the heat receiving surface 20*a*. The protective layer 204B formed through the alumite treatment has the micropores 204D. For increasing the emissivity, the coloring agent 204C is adsorbed to the micropores 204D, so that the whole surface of the nip member 204 is colored so as to be formed like the black body. In this manner, the whole surface of the main-body portion 204A, which includes the rubbed surface 20*b* and the heat receiving surface 20*a*, is colored by using the coloring agent 204C. As a result, the expansion coefficient of the rubbed surface 20*b* becomes equal to the expansion coefficient of the heat receiving surface 20*a*, and thus the nip member 204 is suppressed from warping even if the nip member 204 is made of aluminum. Since the nip member 204 is suppressed from warping, the pressure can be uniformly applied to the fixing belt 201, and the fixing nip portion N can be formed properly. Therefore, a toner image can be reliably fixed to the sheet S. In addition, since the above-described process for forming the protective layer 204B and the process for coloring the protective layer 204B by using the coloring agent 204C are simple, the nip member 204 can be made at low costs.

Other Embodiments

Figure 5:
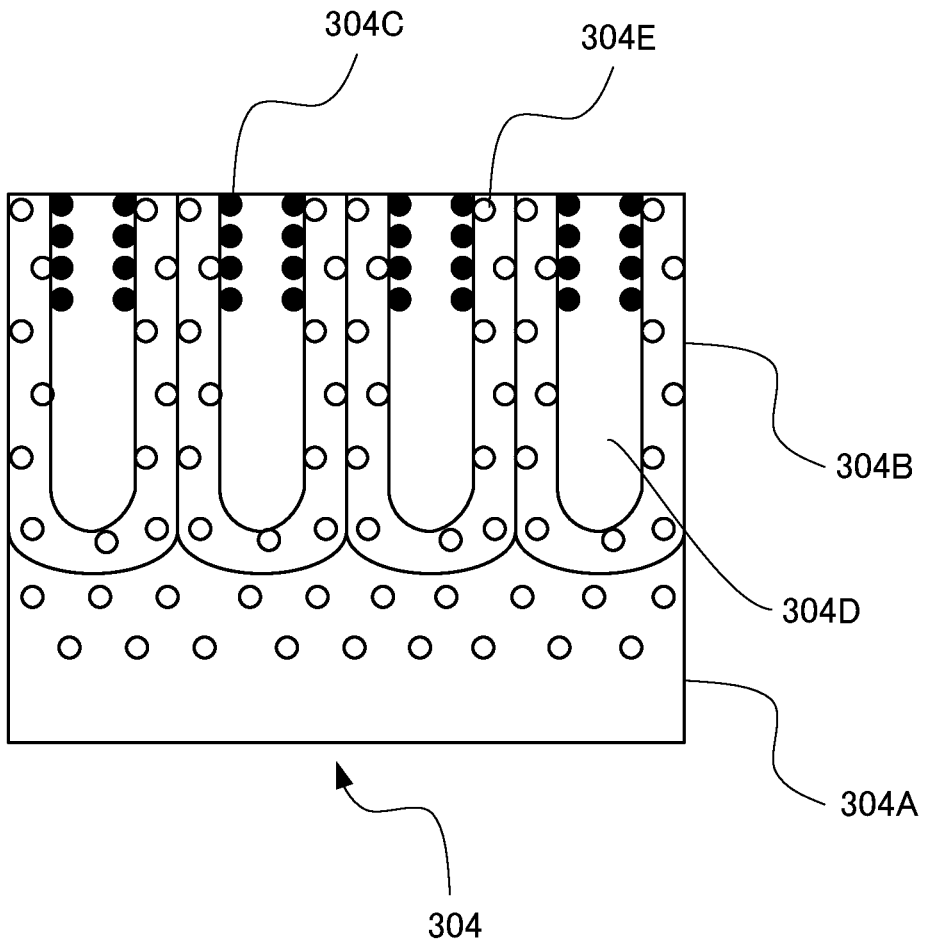
FIG. 5 is a schematic diagram for illustrating coloring of a nip member made of aluminum alloy.

In the above-described embodiment, the base material of the main-body portion 204A is a pure aluminum (JIS1000 based aluminum). However, the present disclosure is not limited to this. For example, the base material of the main-body portion 204A may be any one of various types of aluminum alloy on which a porous oxide film can be easily formed. Examples of the aluminum alloy include an Al—Cu (JIS2000) based aluminum alloy, an Al—Mn (JIS3000) based aluminum alloy, an Al—Si (JIS4000) based aluminum alloy, an Al—Mg (JIS5000) based aluminum alloy, an Al—Mg—Si (JIS6000) based aluminum alloy, and an Al—Zn—Mg (JIS7000) based aluminum alloy. Hereinafter, a nip member 304 in which the base material of a main-body portion 304A is an aluminum alloy will be described with reference to FIG. 5.

If the base material of the main-body portion 304A is an aluminum alloy, a protective layer 304B having a higher emissivity can be formed through an alumite treatment. When an oxide film (protective layer 304B) is formed on an aluminum alloy through the alumite treatment, the metal added to the aluminum alloy is deposited on a surface of the main-body portion 304A and oxidized. Thus, the color of the oxide film changes in accordance with the amount and the dispersion state of metal deposit 304E. The above-described aluminum alloy contains a compound that makes the oxide film black. For example, if the aluminum alloy is an Al—Mn based aluminum alloy, manganese is deposited on the surface of the main-body portion 304A, as the metal deposit 304E. The manganese deposited on the surface of the main-body portion 304A is oxidized, making the protective layer (oxide film) 304B black. In this manner, if the main-body portion 304A is made of aluminum alloy, the black protective layer 304B can be formed on the whole surface of the main-body portion 304A through the alumite treatment. In the present embodiment, the coloring agent is metal deposit deposited in micropores of the oxide film.

In addition to this, the black coloring agent (organic dye) 304C is adsorbed to micropores 304D of the protective layer 304B through the coloring treatment, as described above. With this treatment, the protective layer 304B is made black so that the protective layer 304B can perform heat radiation that is more similar to the heat radiation performed by the black body. That is, the nip member 304 having high emissivity can be formed through the alumite treatment and the coloring treatment, which can be easily performed.

As described above, the nip member 304 includes the main-body portion 304A, and the protective layer 304B formed on the whole surface of the main-body portion 304A. The base material of the main-body portion 304A is an aluminum alloy; and the protective layer 304B is formed through the alumite treatment and the coloring treatment, and contains the black coloring agent. The nip member 304 was heated by the halogen lamp 203, and the surface temperature of the fixing belt 201 was measured. The measurement conditions were the same as those of the case where the base material of the main-body portion 204A was the pure aluminum.

In the case where the base material of the main-body portion 204A was the pure aluminum, the surface temperature of the fixing belt 201 was 160° C. when 5 seconds had elapsed since the start of heating by the halogen lamp 203 (see Table 2). On the other hand, in the case where the base material of the main-body portion 304A was the aluminum alloy, the surface temperature of the fixing belt 201 was 164° C. when 5 seconds had elapsed since the start of heating by the halogen lamp 203.

As described above, if the base material of the main-body portion 304A is an aluminum alloy, the protective layer 304B having a higher emissivity can be formed through the alumite treatment; and the black coloring agent 304C can be adsorbed to the micropores 304D of the protective layer 304B. In this manner, since the nip member 304 can be colored so as to be more similar to the black body, the nip member 304 can efficiently absorb the radiant heat from the halogen lamp 203. In addition, since the whole surface of the main-body portion 304A, which includes the rubbed surface and the heat receiving surface, contains the coloring agent 304C, the expansion coefficient of the rubbed surface becomes equal to the expansion coefficient of the heat receiving surface, and thus the nip member 304 is suppressed from warping. Since the nip member 304 is suppressed from warping, the pressure can be uniformly applied to the fixing belt 201, and the fixing nip portion N can be properly formed. Therefore, a toner image can be reliably fixed to the sheet S.

Note that the method of forming the protective layer 204B (304B) on the whole surface of the main-body portion 204A (304A) may not be the above-described alumite treatment that involves the natural coloring method or the alloy coloring method. For example, the alumite treatment may involve an electrolytic coloring method. In this method, a special electrolytic solution is used, and the color of the oxide film is developed while the oxide film is formed. In addition, the method of coloring (or developing the color of) the protective layer 204B (304B) may not be the above-described dyeing method. For example, the method of coloring the protective layer 204B (304B) may be an electrolytic coloring method. In this method, after the oxide film is formed through the alumite treatment, metal or metal oxide is electrochemically deposited, so that the oxide film is colored.

In the above-described embodiments, the protective layer 204B (304B) that contains the coloring agent 204C (304C) is formed on the whole surface of the main-body portion 204A (304A) that includes the rubbed surface 20*b* and the heat receiving surface 20*a*. However, the present disclosure is not limited to this. For making the expansion coefficient of the rubbed surface 20*b* equal to the expansion coefficient of the heat receiving surface 20*a*, the protective layer 204B (304B) that contains the coloring agent 204C (304C) may be formed on only the rubbed surface 20*b* and the heat receiving surface 20*a* of the whole surface of the main-body portion 204A (304A). However, the protective layer 204B (304B) that contains the coloring agent 204C (304C) is preferably formed on the whole surface of the main-body portion 204A (304A). This is because the nip member 204 (304), which includes the rubbed surface 20*b* having high wear resistance and the radiant-heat receiving surface 20*a* having a high emissivity, can be made easily by using the identical material.

In the above-described embodiments, the halogen lamp (halogen heater) 203 is used as a heating element, for example. However, the present disclosure is not limited to this. For example, the heating element may be another heater, such as an infrared heater or a carbon heater.

In the above-described embodiments, the description has been made as an example for the image forming apparatus 100 in which toner images having different colors are primary-transferred from the photosensitive drums 1Y to 1K onto the intermediate transfer belt 8, and then the resultant toner image having the different colors is collectively secondary-transferred onto the sheet S. However, the present disclosure is not limited to this. For example, the image forming apparatus may be a direct-transfer image forming apparatus in which the toner images having different colors are directly transferred from the photosensitive drums 1Y to 1K onto the sheet S.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-121235, filed Jul. 15, 2020, which is hereby incorporated by reference herein in its entirety.

What is claimed is:

1. A fixing apparatus comprising:

an endless first rotary member;

a heating element disposed inside the first rotary member;

a second rotary member configured to form a nip portion by being contact with an outer circumferential surface of the first rotary member and convey a sheet on which a toner image is formed while fixing the toner image onto the sheet; and a nip member disposed to be rubbed against an inner circumferential surface of the first rotary member and nip the first rotary member with the second rotary member, the nip member being configured to receive radiant heat from the heating element and heat the nip portion, the nip member comprising a main-body portion made of Al-Mn based aluminum alloy that contains manganese and a protective layer that includes an oxide film formed on a surface of the main-body portion, wherein the main-body portion comprises a heat receiving surface that faces the heating element and receives radiant heat from the heating element, and a rubbed surface that is rubbed against the inner circumferential surface of the first rotary member, and wherein the protective layer is formed on the heat receiving surface and the rubbed surface, and contains coloring agent that causes an emissivity of the heat receiving surface and the rubbed surface to be higher than an emissivity of a natural color oxide film.

2. The fixing apparatus according to claim 1, wherein the protective layer that contains the coloring agent is formed on the whole surface of the main-body portion.

3. The fixing apparatus according to claim 1, wherein the protective layer that contains the coloring agent has an emissivity of 0.85 or more and 1.0 or less.

4. The fixing apparatus according to claim 1, wherein the coloring agent is organic dye adsorbed to micropores of the oxide film.

5. The fixing apparatus according to claim 4, wherein the organic dye is chromium complex salt dye.

6. The fixing apparatus according to claim 1, wherein the coloring agent is metal deposit deposited in micropores of the oxide film.

7. The fixing apparatus according to claim 1, further comprising a reflective plate configured to reflect radiant heat from the heating element, toward the nip member.

8. The fixing apparatus according to claim 1, wherein the heating element is a halogen lamp.

9. An image forming apparatus comprising:

a toner image forming unit configured to form a toner image on a sheet; and the fixing apparatus according to claim 1 and configured to fix the toner image formed by the toner image forming unit, to the sheet.

* * * * *